United States Patent [19]

Jones

[11] Patent Number: 4,920,458

[45] Date of Patent: Apr. 24, 1990

[54] INTERACTIVE WORKSTATION

[76] Inventor: Benjamin P. Jones, P.O. Box 9342, Berkeley, Calif. 94708

[21] Appl. No.: 375,141

[22] Filed: Jun. 29, 1989

[51] Int. Cl.[5] ..... A61G 13/00; F21V 13/00

[52] U.S. Cl. ..... 362/33; 312/7.2; 248/917; 248/919

[58] Field of Search ..... 312/7.2, 208; 248/917, 248/924; 362/33

[56] References Cited

U.S. PATENT DOCUMENTS 4,725,106 2/1988 Shields et al. ..... 312/7.2

4,760,277 7/1988 Vurpillat ..... 362/33

*Primary Examiner*—Allen M. Ostrager

[57] ABSTRACT

An ergonomically adjustable multiple VDT display workstation for use in multiuser facilities. It is particularly applicable to VDT display and use, but it may be used for any equipment that can advantageously utilize its structural and functional features. The workstation includes modules assembled to provide four or more embodiments of the workstation. The modules are comprised of a base, worksurface, first and second tier display housing modules, as well as including a light module and a light canopy. The workstation provides a full range of adjustability, for worksurface, keyboards, and display equipment. The workstation fully integrates VDT units and state of the art ergonomics with task and ambient lighting.

5 Claims, 11 Drawing Sheets

INTERACTIVE WORKSTATION

BACKGROUND OF THE INVENTION

There are now more than 15 million video display terminals (VDTs) in the United States with an estimated three million new units produced per year. By the end of the century, 75% of all U.S. jobs will involve some use of VDTs.

The VDT operator is involved in a man-machine based information processing system. The information output can refer to the tactile, the auditory and the visual capabilities of man. Awkward positions to compensate for the incompatibilities of man-machine fit result in reduced comfort, strain and excessive fatigue. Every inadequacy of design or dimension will, in the long run, generate static efforts associated with muscle fatigue, stiffness and pains in the neck, shoulder, arm, and hand area. The cumulative effect over time is a reduction in operator performance, accuracy and speed. This reduction in operator performance may have major economical consequences as it posses a direct threat to an office facilities' operating efficiency.

Recent European research studies on the long-term physical and psychological effects of VDTs on operators have concluded that, to a significant degree, the problems were not caused by the VDTs but rather by the vehicle which brought the terminal and operator together: the furniture. An extensive study on posture and preferred settings of adjustable VDT workstations during subjects' actual working activities was carried out by the Swiss Federal Institute of Technology, Zurich, Switzerland. The study revealed the need for relatively wide ranges of adjustable dimensions. The study conclusively found that "a VDT workstation without adjustable keyboard height and without adjustable height and distance of the screen is not suitable for continuous work with a VDT".

To solve this problem a fully integrated computer workstation was created. It fully integrates worksurface adjustability and state of the art ergonomics with task and ambient lighting in a stand alone workstation.

This invention has been installed and tested by professional operators in a multi-user data control facility for several months. It has been found to successfully reduce operator fatigue and significantly increase operator comfort, productivity, and performance.

Although there are numerous examples of prior art, all known workstations have significant disadvantages when compared to this invention. A number of computer workstations are known in the prior art that are designed for multiple VDT usage and that enabled operators to have some adjustability of the workstation. Some of these workstations may be found to be manually adjustable in height, but their controls, usually a hand operated lift mechanism, are too awkward and slow to meet the needs of a multi-user facility with several operators using many different workstations. A multiple VDT workstation necessarily requires that multiple keyboards be located within reach of the operator. The location and adjustability of the keyboards in the prior art will be found to be sorely lacking. One example has a set of keyboards located on a shelf above the operator forcing him to stand up to use the keyboards. Another example has the keyboards located in a deep recess under the worksurface so that the operator must change position, lean down and pull out a tray to access the keyboards. The location an angle of the display is critical. In one prior art design, the VDT units are mounted vertically three units high and are an obvious violation of ergonomic standards; causing the operator unnecessary strain of his eyes and neck to read the uppermost display. Lighting of these prior art workstations is inadequate at best and no provision has been made to address a balance of illumination that incorporates both task and ambient lighting.

The general problem that this invention solves is to provide an multiple VDT display workstation that is easily and quickly adjustable, is ergonomically correct in its design, and successfully incorporates both task and ambient lighting.

SUMMARY

The present invention describes an interactive workstation configured as individual modules comprised of Base, Worksurface, First Tier, Second Tier, Light, and Light Canopy modules.

The modular segments are constructed of small, lightweight panels and interchangeable parts. The invention has been designed so it can be easily shipped and assembled with standard tools. Its unique design enables the users to create a totally integrated VDT work environment that includes worksurface, display wall, ceiling, and lighting elements.

All workstation components are easily adjustable to meet the individual requirements of each operator. An electrically operated vertical lift mechanism quickly and easily controls the height adjustment of the worksurface. The VDT keyboards are located on top of the worksurface and underneath the worksurface on horizontally extending keyboard trays. The keyboard trays are equipped with wrist rests and anti-static strips for operator comfort and safety. The adjustable height worksurface allows the VDT keyboards to be set at the most comfortable position. All controls are located on the worksurface within easy reach of the operator.

The VDT units rest on horizontally extending shelves that are fully adjustable for setting the height and angle of each VDT unit. These adjustments allow for correct positioning of the VDT in relationship to the operator.

This workstation accommodates virtually all sizes of VDT's currently on the market, including large flat screen (LED) types as well as cathode ray tube (CRT) types. Access to VDT units occurs directly from the front through display doors. Each display door contains glare reducing and contrast enhancing optical glass. The glass is specially treated to provide a shield for VLF (very low frequency) and ELF (extremely low frequency) radiation. In addition, the glass neutralizes 98% of the static electric field produced by each VDT.

The invention successfully solves problem of illuminating a worksurface without throwing glare onto the VDT screen or into the eyes of the operator. Task lighting is provided through individually controlled task light fixtures located in the light module above the operator. The task light is designed to provide a controlled beam of light that illuminates the worksurface. Ambient lighting is provided through an indirect uplight fixture located in the light module. An overhead light canopy controls the distribution of the indirect reflected light produced by the uplight fixture.

Further objects and advantages of the invention will become apparent from a consideration of the drawings and ensuing description of it.

DRAWINGS

DETAILED DESCRIPTION OF THE INVENTION

The present invention is comprised of up to six modular assemblies; a Base Module, a Worksurface Module, a First Tier Module, a Second Tier Module, a Light Module, and a Light Canopy Module.

The aforementioned modules may be combined to comprise four or more embodiments.

In the following description numerous specific details are set forth, such as specific number of modules, in order to provide a through understanding of the present invention, It will be obvious to one skilled in the art that the present invention may be practiced without these specific details. In other instances, well-known structures are not described in detail in order not to unnecessarily obscure the present invention.

Figure 1A:
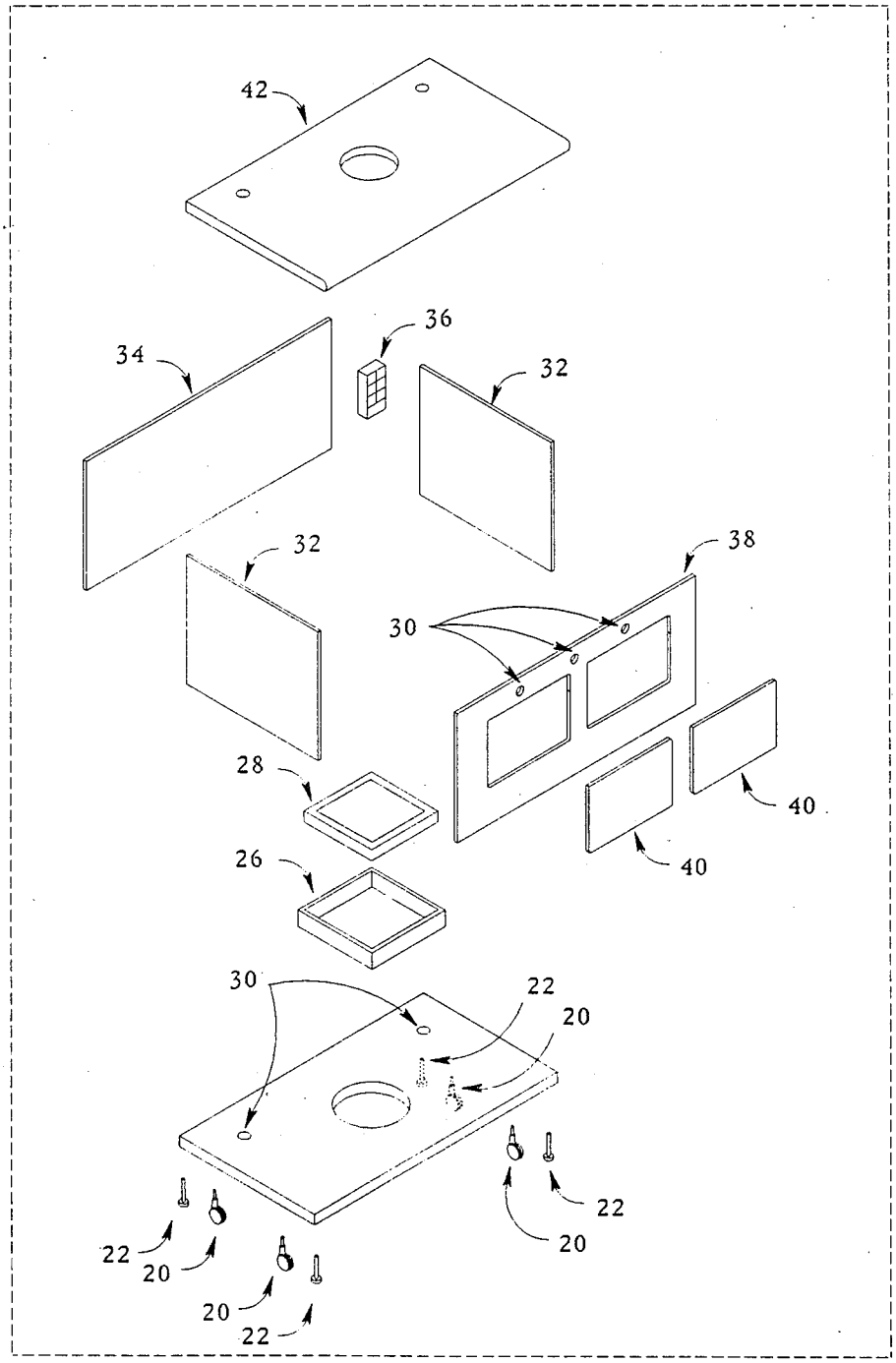
FIG. 1A shows an exploded view of the Base Module.
Figure 1B:
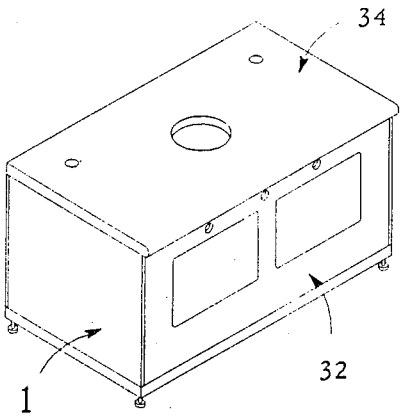
FIG. 1B is a pictorial representation of an assembled Base Module.

The following will describe in detail each module and their respective components An exploded view and of an assembled view of the Base Module is shown in FIGS. 1A and 1B, respectively. A set of casters 20 and a set of levelers 22 are mounted to the underside of a base panel 24. A air filter tray 26 is mounted over an aperture in the base panel 24. A removable air filter 28 is installed in the air filter tray 26. A set of power and computer cable grommets 30 are installed in the base panel 24. A set of side panels 32L and 32R and a back panel 34 are joined together and fastened to the base panel 24. A power unit 36 is attached to the back panel 34. A front panel 38 is attached to the side panels 32L and 32R and to the base panel 24. A set of access doors 40L and 40R are hinged to the front panel 38 and are locked by touch latches mounted to the front panel 38. A set of power and computer cable grommets 30 are installed in the front panel 38. A top panel 42 is mounted to the side panels 32L and 32R, and to the back panel 34.

Figure 2A:
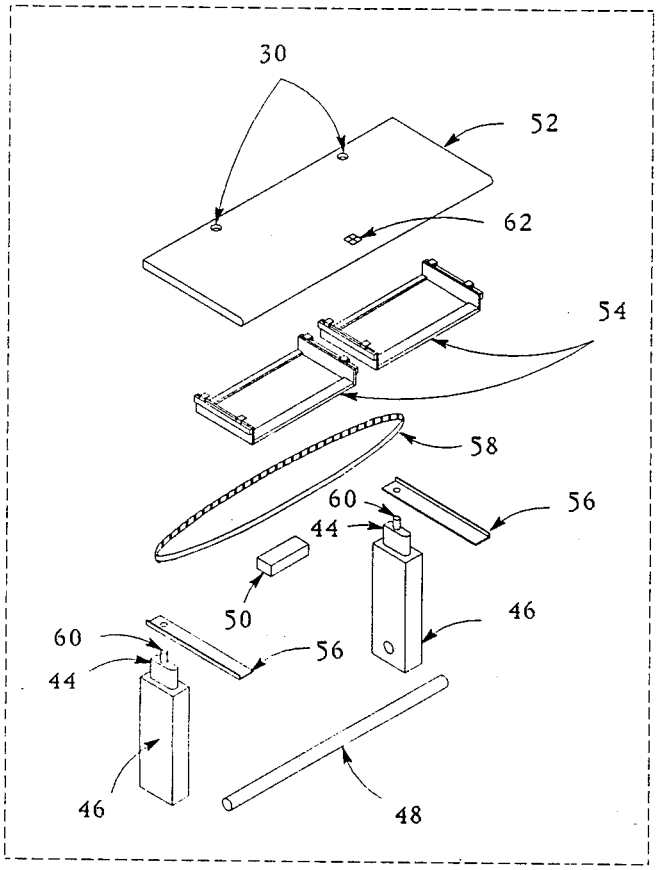
FIG. 2A shows an exploded view of the Worksurface Module.
Figure 2B:
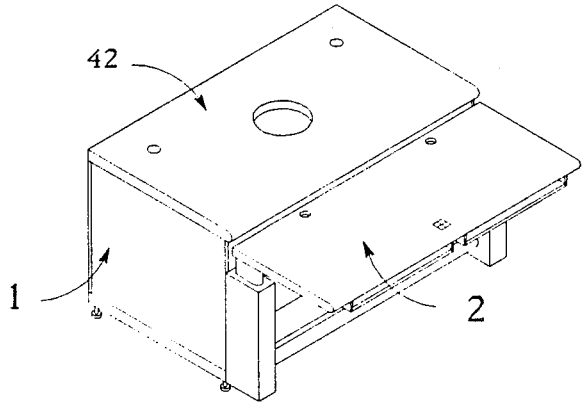
FIG. 2B is a pictorial representation of an assembled Worksurface Module attached to the Base Module.

Referring to FIGS. 2A and 2B, an exploded view of the Worksurface Module is shown in FIG. 2A and an assembled Worksurface Module attached to the Base Module is shown in FIG. 2B. A vertical lift mechanism 44 is installed within a set of leg mounts 46L and 46R. A footrest 48 is mounted between the two leg mounts 46L and 46R. The set of leg mounts 46L and 46R are attached to the front panel 38. An electric motor 50 is mounted to the underside of a worksurface 52. A set of keyboard trays 54L and 54R are mounted to the underside of the worksurface 52. A set of support brackets 56L and 56R are mounted to the top of the vertical lift mechanism 44. The worksurface 52 is attached to the set of support brackets 56L and 56R. A drive belt 58 is connected to a set of two drive screws 60 on the vertical lift mechanism 44 and to the electric motor 50. A set of power and computer cable grommets 30 are installed in the worksurface 52. A control panel 62 is installed on the face of the worksurface 52. The electric motor 50 is connected to the power unit 36 and to the control panel 62.

Figure 3A:
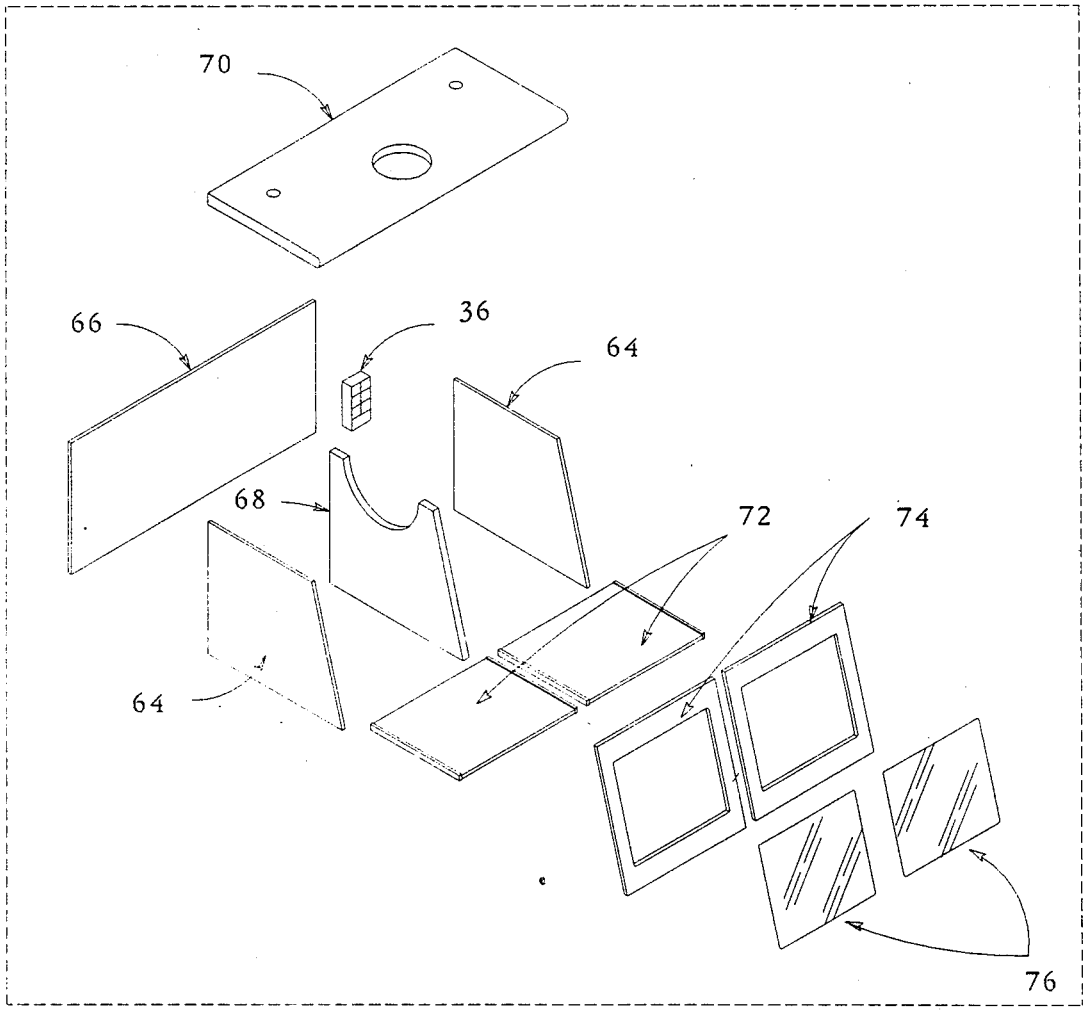
FIG. 3A shows an exploded view of the First Tier Module.
Figure 3B:
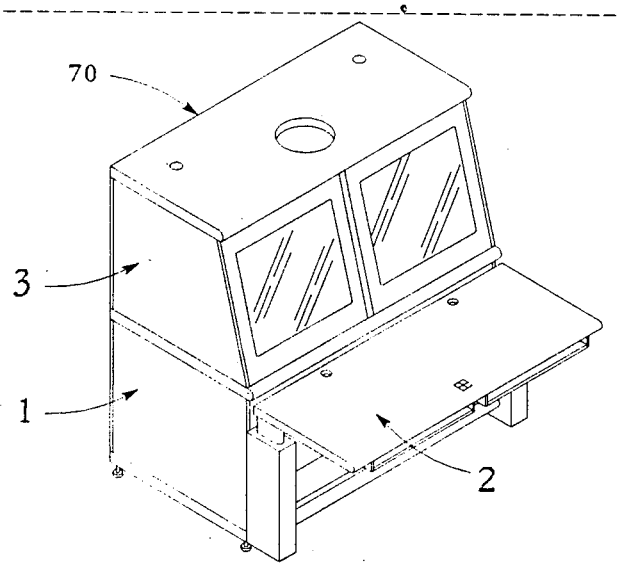
FIG. 3B is a pictorial representation of an assembled First Tier Module attached to the Base and Worksurface Modules.

Referring to FIGS. 3A and 3B, an exploded view of the First Tier Module is shown in FIG. 3A and an assembled First Tier Module attached to the Base Module is shown in FIG. 3B. A set of side panels 64L and 64R and a back panel 66 are joined together and fastened to the top panel 42. A power unit 36 is attached to the back panel 66. A center panel 68 is fastened to the top panel 42 and to the back panel 66. A top panel 70 is attached to the side panels 64L and 64R, the back panel 66, and the center panel 68. A set of VDT shelf assemblies 72L and 72R are attached to the inside faces of the side panels 64L and 64R and the center panel 68.

A set of display doors 74L and 74R are hinged to the top panel 70 and are locked by touch latches mounted to the top panel 42. A pair of hold open hardware mounted is mounted to each display door 74L and 74R, and to the inside faces of the side panels 64L and 64R and the center panel 68. A piece of display glass 76 is inserted into each display door and held by glass clips. A grounding wire is attached to each piece of display glass 76 and connected to the power unit 36.

Figure 4A:
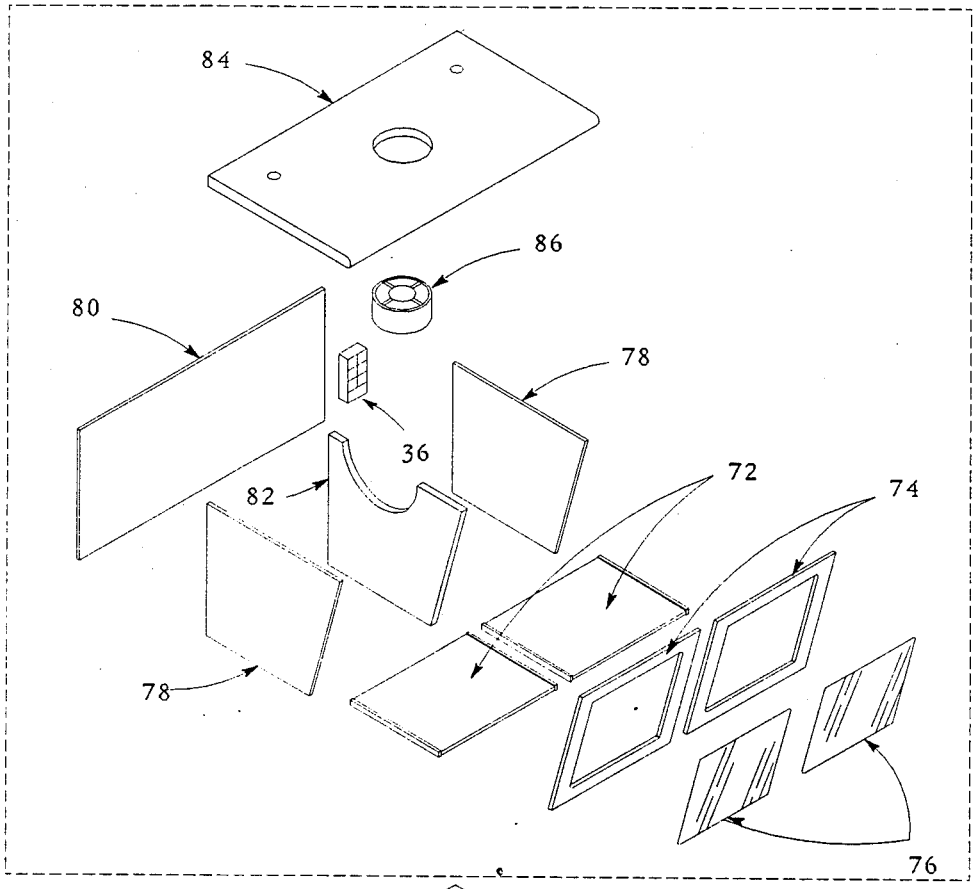
FIG. 4A shows an exploded view of the Second Tier Module.
Figure 4B:
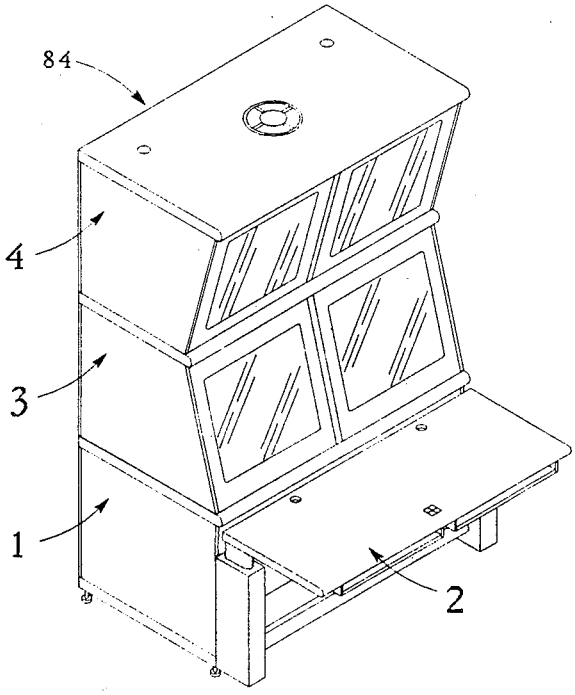
FIG. 4B is a pictorial representation of an assembled Second Tier Module attached to the First Tier Module.

Referring to FIGS. 4A and 4B, an exploded view of the Second Tier Module is shown in FIG. 4A and an assembled Second Tier Module attached to the First Tier Module is shown in FIG. 4B. A set of side panels 78L and 78R and a back panel 80 are joined together and fastened to the top panel 70. A power unit 36 is attached to the back panel 80. A center panel 82 is fastened to the top panel 70 and to the back panel 80. A top panel 84 is attached to the side panels 78L and 78R, the back panel 80, and the center panel 82. A continuously operating, low decibel fan 86 is installed in the top panel 84. A set of VDT shelf assemblies 72L and 72R are attached to the inside faces of the side panels 78L and 78R and the center panel 82. A set of display doors 74L and 74R are hinged to the top panel 84 and are locked by touch latches mounted to the top panel 70. A pair of hold open hardware mounted is mounted to each display door 74L and 74R, and to the inside faces of the side panels 78L and 78R and the center panel 82. A piece of display glass 76 is inserted into each display door and held by glass clips. A grounding wire is attached to each piece of display glass 76 and connected to the power unit 36.

Figure 5A:
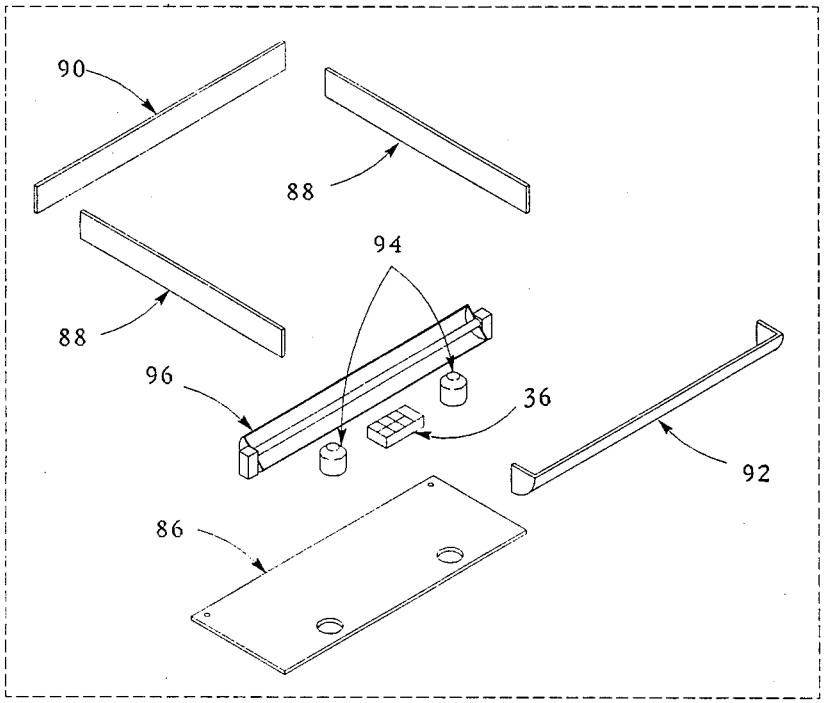
FIG. 5A shows an exploded view of the Light Module.
Figure 5B:
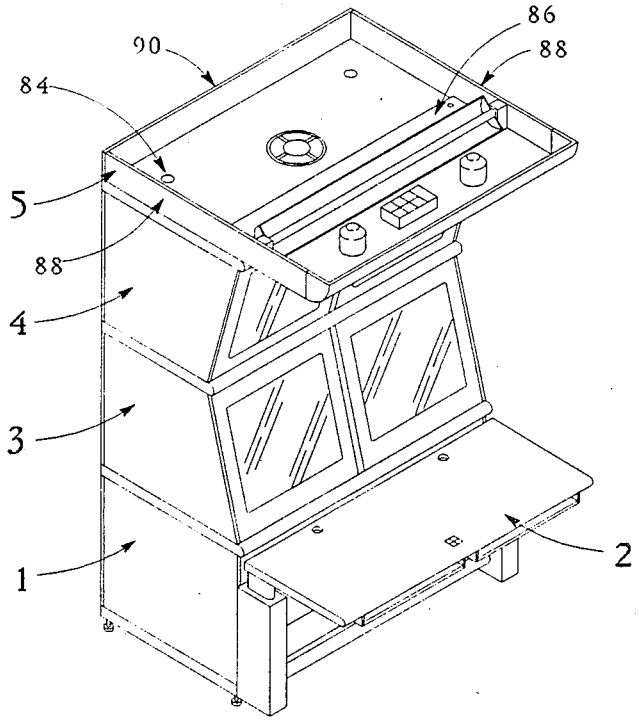
FIG. 5B is a pictorial representation of an assembled Light Module attached to the Second Tier Module.

Referring to FIGS. 5A and 5B, an exploded view of the Light Module is shown in FIG. 5A and an assembled Light Module attached to the Second Tier Module is shown in FIG. 5B A set of side panels 88L and 88R and a back panel 90 are joined together and fastened to the top panel 84. The soffit panel 86 is attached to the side panels 88L and 88R. A front piece 92 is attached to the soffit panel 86 and to the side panels 88L and 88R. A power unit 36 is mounted to the soffit panel 86. A set of task light fixtures 94L and 94R are mounted to the soffit panel 86 and connected to the power unit 36. An indirect uplight fixture 96 is mounted to the soffit panel 86 and connected to the power unit 36.

Figure 6A:
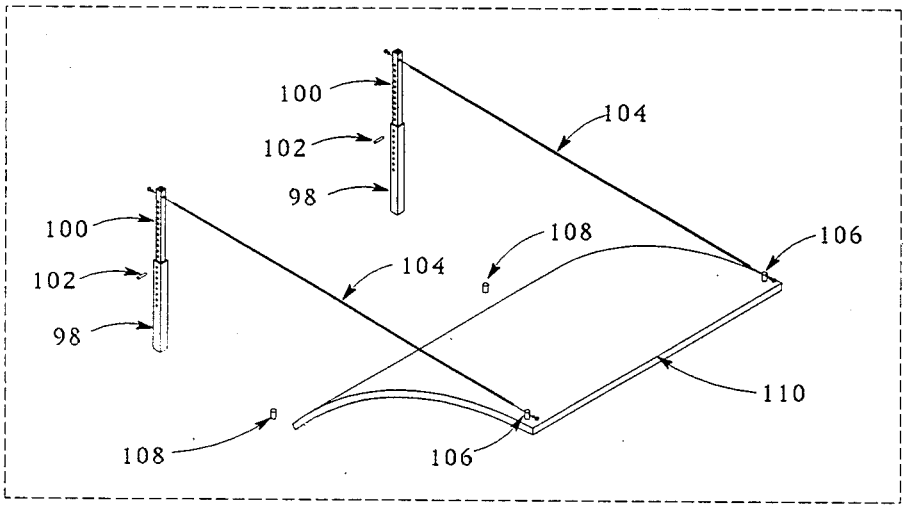
FIG. 6A shows an exploded view of the Light Canopy Module.
Figure 6B:
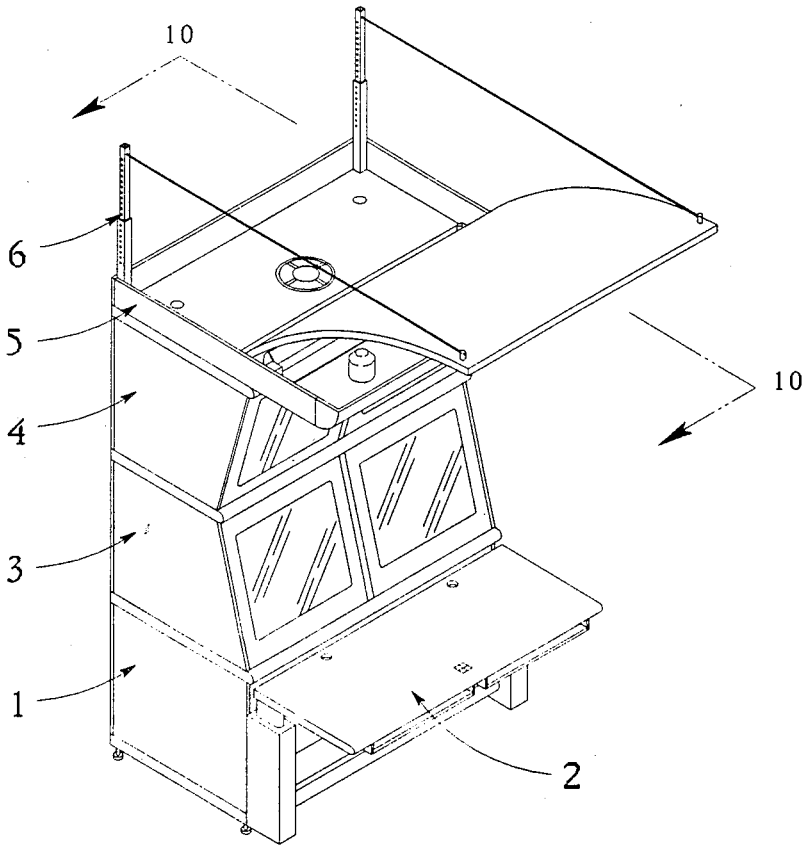
FIG. 6B is a pictorial representation of an assembled Double with Light and Light Canopy Unit showing a Base, Worksurface, First Tier, Second Tier, Light, and Light Canopy Module of the preferred embodiment.

Referring to FIGS. 6A and 6B, an exploded view of the Light Canopy Module is shown in FIG. 6A and a completely assembled unit is shown in FIG. 6B A set of upright supports 98 are fastened to the two side panels 88L and 88R and to the top panel 84. The upright supports 98 each have an inner sleeve 100 that can be vertically adjusted and locked into position by a set of pins 102. A set of support cables 104 are attached to the upright support inner sleeves 98 and extend to a set of brackets 106 attached to a canopy panel 110. A set of support pins 108 are mounted in the top of the soffit panel 86. The canopy panel 110 rests on the support pins 102 and is held in place by the cables 104 and brackets 106.

Figure 7:
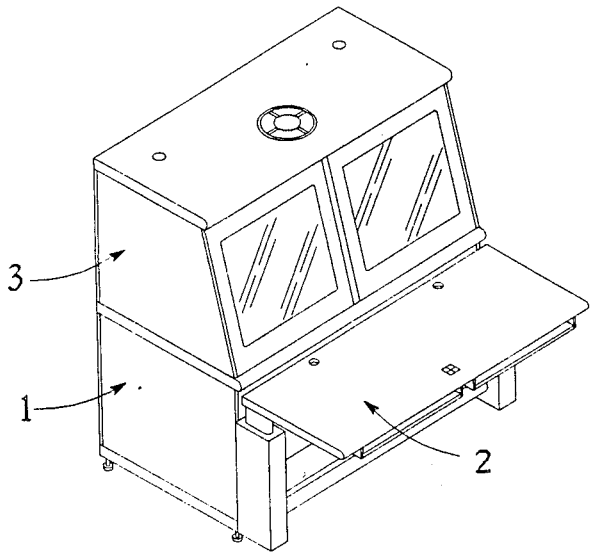
FIG. 7 is a pictorial representation of an assembled Single Unit showing a Base, Worksurface and First Tier Module having a fan included therein.
Figure 8:
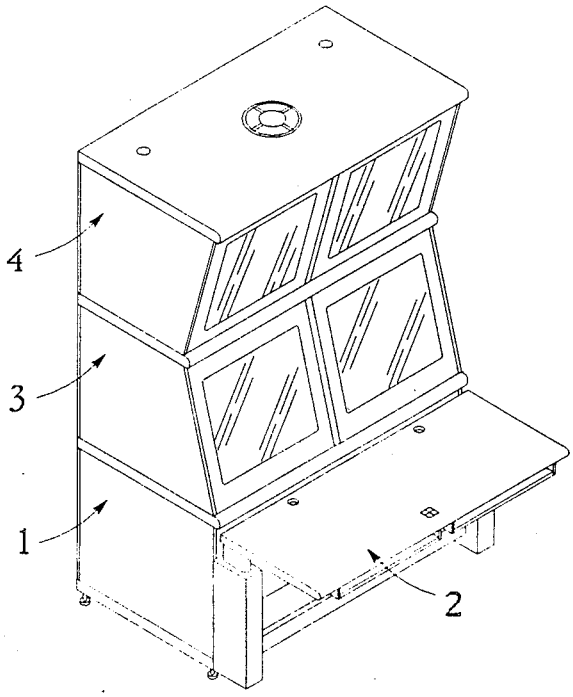
FIG. 8 is a pictorial representation of an assembled Double Unit showing a Base, Worksurface, First Tier and Second Tier Module.
Figure 9:
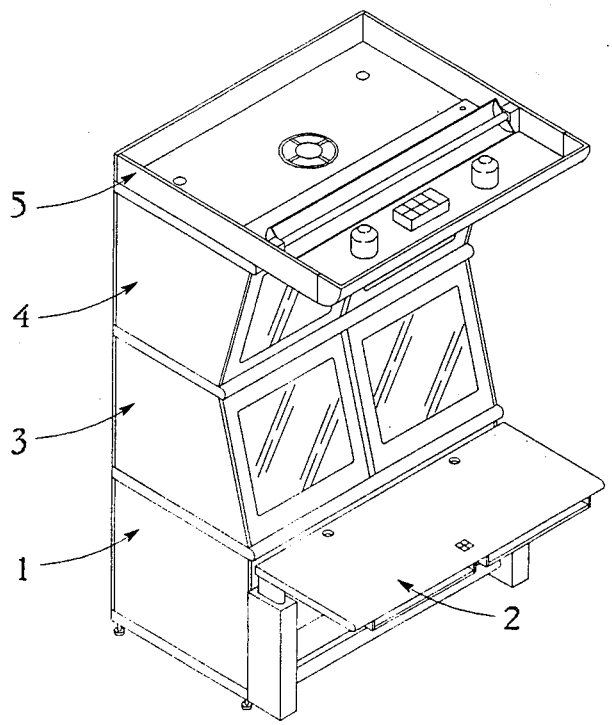
FIG. 9 is a pictorial representation of an assembled Double with Light Unit showing a Base, Worksurface, First Tier, Second Tier, and Light Module.

The aforementioned modules may be combined to comprise four or more embodiments, wherein the preferred embodiment is shown in FIG. 6B and three alternative embodiments are shown in FIGS. 7, 8, and 9.

EXPLANATION OF HOW THE INVENTION OPERATES

As referenced in drawings of FIG. 1A–6B, the invention in its preferred embodiment as shown in FIG. 6B operates as follows:

The assembled workstation unit is fully mobile and rolls on a set of casters 20. It is moved into the desired position and made stationary and leveled by a set of levelers 22. Power and computer cables from the facility are inserted through a set of grommets 30 located in a base panel 24.

The power cable from the facility is connected to a power unit 36 located on the back panel 34 of the base module. All of the power units 36 of the modules utilized for each configuration are connected together so as to form a continuous circuit. The power units provide a surge protected, EFI and RFI shielded power source for the VDT units and accessories.

Computer cables are connected to their respective VDT units and accessories. Access to the VDT units occurs directly from the front through the display doors 74. The display doors 74 are opened by means of concealed touch latches and are held in the open position by a set of hold open hardware. The VDT units rest on the shelf assemblies 72 that fully extend horizontally and have an integral tilt mechanism to adjust the angle of each VDT unit for comfortable screen height and position.

Figure 10:
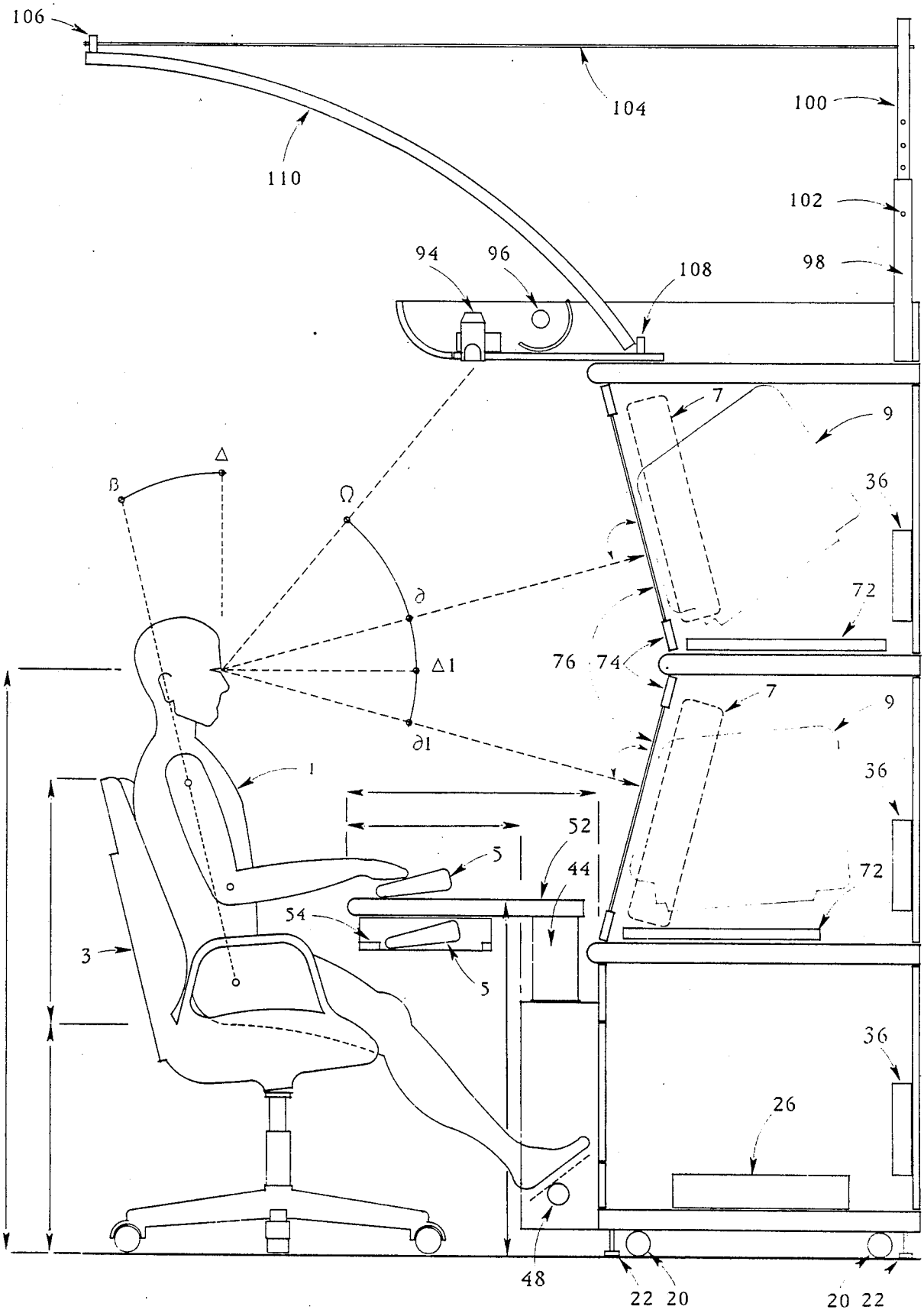
FIG. 10 shows a sectional view of the preferred embodiment indicated by the section lines 10—10 in FIG. 6B and further showing a positioning of a seated operator using a keyboard and showing the location VDTs residing therein.

This workstation accommodates virtually all sizes of VDT's currently on the market. FIG. 10 depicts two of the more common types of VDT units: a flat screen (LCD) type 7 and a cathode ray tube (CRT) type 9. A pair of VDT keyboards 5 are located on the top of a worksurface 52, and another pair of VDT keyboards are located underneath the worksurface on a set of keyboard trays 54L and 54R. Keyboard extension cables connect the keyboards to their respective VDT units and are routed through the sets of grommets 30 located in the worksurface 52 and front panel 38. Depending on operator preference, the keyboards can control either of the VDT units housed in the first tier and second tier modules.

A set of access doors 40L and 40R allow for easy access to computer and power cables and to an air filter tray 26. The air filter tray 26 holds a replaceable air filter 28 and is the main source for ventilation air intake. A continuously operating, low decibel fan 86 provides required ventilation and is located either in the top panel 84 of the second tier module as shown in FIG. 4A, or in the top panel 70 of the single tier module as shown in FIG. 7. The fan 86 is connected to the nearest power unit 36 depending upon the configuration. The center panels 68 and 82 located in the first and second tier modules respectively, are shaped to allow for fan clearance and internal ventilation.

Referring to FIG. 10, an operator 1 is shown seated in a chair 3 at the worksurface 52 facing the VDT units 7 and 9 located inside the first and second tier display modules. The VDT keyboards 5 are shown located on top of the worksurface 52 and below the worksurface on a keyboard tray 54. A range of dimensions for an operators ' eye level above floor is approximately 47 to 52" as shown. The seat height level above the floor is approximately 17 to 19.5". The backrest for a VDT chair is shown as approximately 20 to 24" above seat level.

The ergonomic studies on VDT workstations disclosed that operators prefer postures similar to those of car drivers: they tend lean backwards with upper arms kept higher than expected, with slightly open elbow angles and tend to stretch out their legs. On the average they lean back a range of 1° to 20° from the vertical (angle Δ as above is FIG. 10). The mean average mean is approximately 104° (angle B as shown in FIG. 10) as shown in FIG. 10. A backward leaning posture is justified since it allows relaxation of the back muscles and decreases the load on the intervertebral discs. Since heightened pressure inside intervertebral discs means that they are stressed and will wear out more quickly, the conclusion is obvious that a proper sitting posture with reduced disc pressure is both healthy and desirable.

To enable this backward leaning posture to happen, an adequate area from the table edge to the back wall is provided for outstretched legs as shown in FIG. 10. The minimum required distance at the level of the knees is 15" and the minimum required distance at the level of the toes is 24". A footrest 48 allows the operator to easily assume a backward reclining posture and enables the operators' feet to be in an elevated, ergonomically correct position. The footrest 48 is a neoprene wrapped metal tube located to accommodate all foot positions and angles of impact.

The ergonomic findings also showed an increased incidence of physical discomfort when the height of the VDT keyboard was too low, and when forearm and wrists could not rest on a support. Each keyboard tray 54 fully extends horizontally and is equipped with a wristrest and anti-static strip for operator comfort and safety. The worksurface 52 is fully adjustable in height and allows each keyboard 5 to be set at the most comfortable position to meet the individual requirements of each operator. The electrically operated vertical lift mechanism 44 quickly and easily adjusts the height of the worksurface 52. The range of adjustability of worksurface height is from 26.5 to 33.5" as shown in FIG. 10.

As shown in FIG. 2A, the vertical lift mechanism 44 is controlled by a control panel 62 located on the top of the worksurface 52 within easy reach of the operator. The vertical lift mechanism 44 is comprised of a set of vertical drive screws 60 located within a set of threaded shafts. The set of vertical drive screws 60 are connected to a drive belt 58 and driven by an electrical motor 50.

Ergonomic studies have shown that postural and visual factors are inseparable. The position of the operator's head in relation to the display, and the posture of the head in relation to the spine and shoulders can greatly affect the incidence of fatigue. If the eyes work too intensively and in too large a field of vision, the eye muscles become tired. When seated, the normal site-line is approximately 15° above the horizontal. If the eyes have to be elevated to read a display above this line, the eyeball must be rotated upwards. If this is a constant or repetitious requirement, it causes an imbalance in normal contraction of the six tiny muscles that control the eye ball within the socket. In particular, the superious rectus will be most affected and will become statically loaded if not relieved for reasonable periods. Consequently, poor blood flow and heat transfer can produce major discomfort in this area. Therefore the display doors and glass are located at the correct angle, height and distance for comfortable viewing by the operator as shown in FIG. 10. The comfortable visual downward angle, (angle 21) eye to screen center, is shown as approximately 15° below the horizontal (angle Δ1). The comfortable visual upward angle (angle 2), eye to screen center, is shown as approximately 15° above the horizontal (angle Δ1). The comfortable visual distance, eye to screen center, is shown as 29" to 38".

VDTs like television sets may emit two kinds of radiation, ionizing and non-ionizing. Ionizing radiation, which includes x-rays, in large amounts can kill or genetically damage living cells. VDTs give off nonionizing radiation which is far less potent and given the weak energy field of VDTs, is not generally considered harmful. However the possibility that low frequency magnetic radiation may have teratogenic effects is currently being explored. Recent studies suggest the weak electromagnetic fields are capable of interacting with biological systems. To guard against possible adverse health affects of these emissions each piece of display glass 76 is specially treated to shield the operator from VLF (very low frequency) and ELF (extremely low frequency) magnetic radiation.

Another source of concern is the electrostatic field produced by the VDT screen itself. This may produce a negative charge on the face or skin of the operator and be responsible for some of the skin rashes and dermatological symptoms that have been reported by operators. In this invention, the electrostatic field produced by the VDT is neutralized by the display glass 76 and is drawn away by means of a grounding wire connected to the power unit 36. These pieces of display glass are sized to completely cover the VDT units and to provide maximum shielding. Each piece of display glass 76 is also treated to reduce glare and improve the contrast and clarity of the output on the VDT screen.

Incorrect lighting will produce incorrect posture. Operators are more sensitive to visual strain and inadequate lighting conditions which can cause constrained postures. Bad placement and direction of light will mean that the neck has to carry weight at awkward angles. Light sources must be located so that they do not reflect into the eyes of the operator or onto the display. This is accomplished by locating a task light 94 directly over the worksurface but out of the operators visual cutoff angle of 50° as shown in FIG. 10. The task light fixtures 94 are located in such a position as to eliminate any glare from falling into both the operators' line of vision or onto the display glass 76. The lamp used in the task light fixture provides a controlled beam that falls only illuminates the worksurface 52. An example of such a light is an Mr 16 light fixture with a 50 Watt Narrow Flood Lamp. The task light fixtures 94 are adjusted and controlled by the control panel 62 located on the worksurface 52.

Studies have shown that here is a direct relationship between lighting and productivity. An adequate level of glare free ambient light is essential to provide balanced illumination in a VDT work environment. In the invention ambient light is provided by an indirect uplight fixture 96 located in the soffit panel 86 of the light module as shown in FIG. 5A. A 40 Watt fluorescent lammp is installed in the uplight fixture 96. This uplight fixture is connected to a power unit 36 and controlled by the control panel 63 on the worksurface 52. The uplight fixture 96 provides a glare free source of indirect ambient light. The light canopy 110 diffuses and reflects the light produced by the uplight fixture. The light canopy 110 is a curved, flexible acoustical panel. The light canopy is supported by a system of uprights (98L and 98R and cables 104 as shown in FIG. 6A. The height and angle of the light canopy 110 are adjustable to meet specific requirements of the work space. Its height is adjusted by raising or lowering a set of inner sleeve supports 100 and locked into position with a set of locking pins 102.

The invention has been designed so it can be easily shipped and assembled. It consists of small light weight panels and components that are easily connected with standard tools. Each lightweight panel is comprised of a particle board frame with a honey comb infill panel wrapped with plastic laminate. However it is appreciated that any structurally supportive materials can be readily used. Units are constructed in modular segments of interchangeable parts as shown in FIGS. 1A to 6A. Its ease of construction allows lay persons to assemble the product.

The inventions' distinctive, hi-tech appearance complements the technology which it contains. Its clean, streamlined appearance eliminates distracting hardware and increases viewing ability. Matte finishes are used throughout to minimize glare. Rounded edges on the worksurface 52 and on the exposed edges of the top panels 42, 30, and 70, in addition to the curved front piece 92 on the light module, combine to create a distinctive design vocabulary. The unique design enables the users to create a complete working environment comprising a worksurface, display wall, lighting, and ceiling.

Those skilled in the art will envision many other possible variations that are within its scope. For example, skilled artisans will readily be able to change the dimensions and shapes of the various embodiments. They will also be able to make all components invention of alternative materials such as plastic, metal, wood, particle board or other materials. Many other variations are possible. For example, the invention could be constructed with fewer or more panels or components to provide the same embodiment. Instead of a system of small lightweight panels it may be two full length vertical side panels with horizontal panels mounted in between. In addition, the back panels, rather than being separate panels, could be one continuous piece of material to match the height of each configuration. In another example, the invention could be constructed using a metal or other material support framework upon which panels could then be attached. The worksurface could be nonadjustable and fixed at a predetermined height. The worksurface could be tilting, rotatable or adjustable in another manner. The vertical lift mechanism may be a pneumatically, spring loaded, gear driven or other type of lift motor. The vertical lift mechanism may be contained within a single leg or may be located in another area such as at the opposite ends of the worksurface. In addition, it may be a manually operated device such as a hand cranked lift mechanism. The controls for the lift mechanism could be located in another area other than the top of the worksurface such as in a foot pedal or other device. The means for controlling the height and angle of the VDT units may be a motorized system controlled remotely by the operator. The keyboard trays may be eliminated in one embodiment that would locate all keyboard trays on the top of the worksurface. In addition, the keyboard s could be embedded into the body of the worksurface itself.

With respect to the indirect ambient lighting means, another possible embodiment of the invention might be to eliminate the light canopy module and to simply reflect the light produced by the indirect fixture off of a ceiling or another planar surface. The task and ambient light fixtures described herein could be differently shaped, attached, or specified to achieve the same illumination results as the invention.

Although the invention depicts VDT units within it, it would readily hold any equipment for display such as monitors, alarm, control panels, rack amounts, or other displays. Additional components could be added such as telephones or other communication devices.

While the above description contains many specificities, the reader should not construe these as limitations on the scope of the invention, but merely as exemplifications of preferred embodiments thereof.

I claim:

1. An equipment housing comprising:

a base module having a substantially planar upper surface for providing a base foundation;

a worksurface module coupled to said base module and having a substantially planar upper surface to accommodate a device for human interaction;

said worksurface module being adjustable to adjust the height of said upper surface for providing ergonomic positioning of said device for human interaction;

a first tier display housing module residing on said upper surface of said base module for housing a first display unit;

said first tier display housing module residing on said upper panel of said first tier display housing display comprised of a back, two sides, an upper and a front panels;

a second tier display housing module residing on said upper surface of said first tier display housing module for housing a second display unit;

said second tier display housing module comprised of a back, two sides, an upper and a front panels, wherein said front panel of said first tier display housing module is angled approximately 15° upward from the vertical, away from an operator, and said front panel of said second tier display housing module is angled approximately 15° downward from the vertical, towards said operator.

2. The equipment housing of claim 1 wherein said first and second tier display housing modules further including a radiation shield with each of said front panels.

3. The equipment housing of claim 2 further including a light module disposed above said upper panel of said second tier display module for housing a lighting means, wherein said lighting means for illuminating said upper surface of said work surface module.

4. The equipment housing of claim 3 wherein said lighting means is a focused beam light fixture for focusing a beam of light onto said worksurface module.

5. The equipment housing of claim 4 wherein said lighting means is an indirect uplight fixture for providing ambient light.

* * * * *